US006508540B1

(12) United States Patent
Lean et al.

(10) Patent No.: US 6,508,540 B1
(45) Date of Patent: Jan. 21, 2003

(54) FRINGE FIELD ELECTRODE ARRAY FOR SIMULTANEOUS PAPER TACKING AND FIELD ASSIST

(75) Inventors: Meng H. Lean, Briarcliff Manor, NY (US); Vittorio R. Castelli, Yorktown Heights, NY (US)

(73) Assignee: Xerox Corporation, Stamford, CT (US)

( * ) Notice: Subject to any disclaimer, the term of this patent is extended or adjusted under 35 U.S.C. 154(b) by 15 days.

(21) Appl. No.: 09/692,590

(22) Filed: Oct. 20, 2000

(51) Int. Cl.[7] ..... B41J 2/06
(52) U.S. Cl. ..... 347/55; 347/104
(58) Field of Search ..... 347/55, 104, 76, 347/77, 34, 46, 15

(56) References Cited

U.S. PATENT DOCUMENTS

| | | | | |
|---|---|---|---|---|
| 4,293,865 A | * | 10/1981 | Jinnai et al. | 347/55 |
| 5,877,790 A | * | 3/1999 | Higiwara et al. | 347/55 |
| 5,975,683 A | | 11/1999 | Smith et al. | 347/55 |
| 6,079,814 A | | 6/2000 | Lean et al. | 347/55 |
| 6,309,064 B1 | * | 10/2001 | Tanno et al. | 347/104 |

* cited by examiner

*Primary Examiner*—Anh T. N. Vo
*Assistant Examiner*—M Shah
(74) *Attorney, Agent, or Firm*—Perman & Green, LLP

(57) ABSTRACT

The tacking pressure and droplet acceleration force in an ink jet printer is provided by an array of electrodes mounted under the transport mechanism. The array consists of multiple pairs of oppositely charged electrodes and the array is maintained at a bias voltage while the print head of the printer is grounded.

15 Claims, 8 Drawing Sheets

FIG. 7
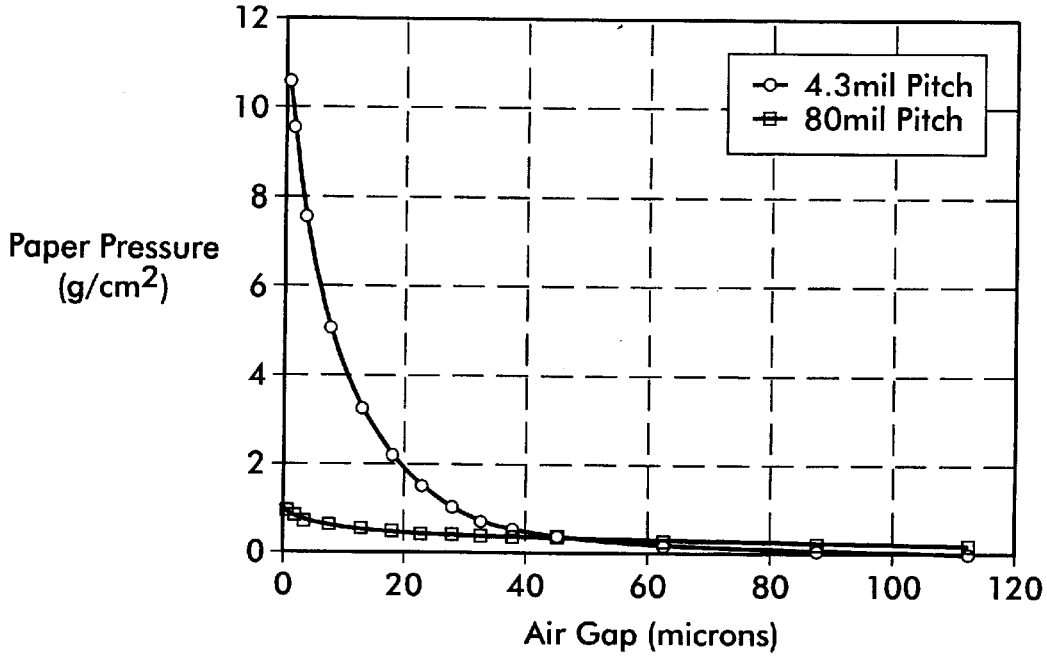
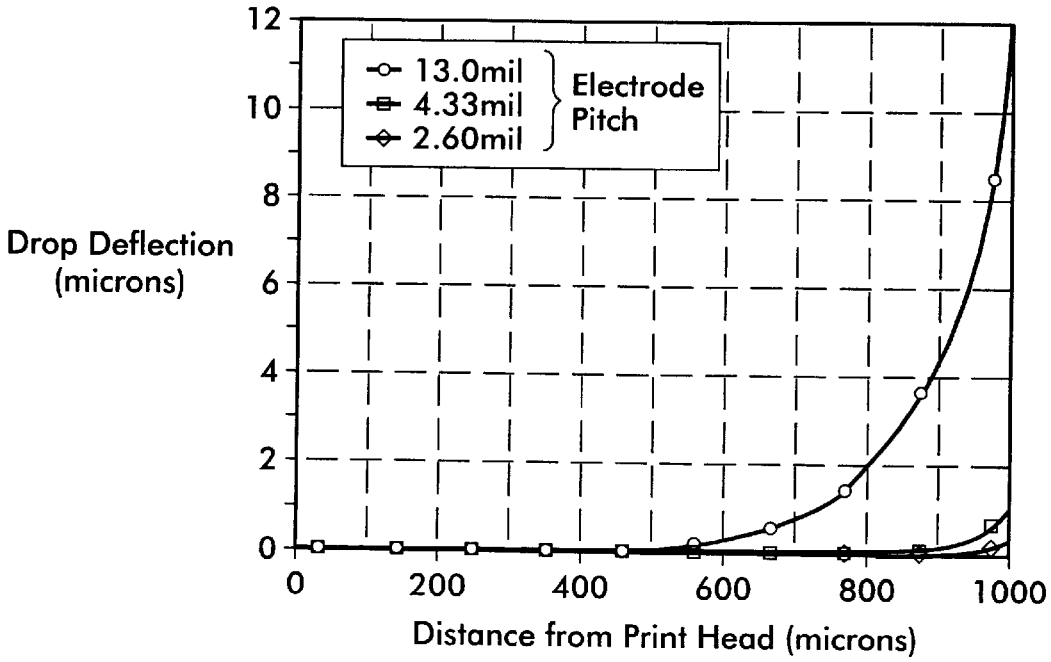
FIG. 8

FRINGE FIELD ELECTRODE ARRAY FOR SIMULTANEOUS PAPER TACKING AND FIELD ASSIST

BACKGROUND OF THE INVENTION

Conventional ink jet printing systems use various different methods to produce ink droplets directed toward a recording medium. Well known devices for ink jet printing include thermal, piezoelectric, and acoustic ink jet print heads. All of these technologies produce roughly spherical ink droplets having a 15–100 $\mu$m diameter directed toward a recording medium at approximately 4 m/sec. The ejecting transducers or actuators in the print heads, which produce the ink droplets, are controlled by a printer microcomputer or controller. The printer controller activates the transducers or actuators in conjunction with movement of the recording medium relative to the print head. By controlling the activation of the transducers or actuators and the recording medium movement, the printer controller directs the ink droplets to impact the recording medium in a specific pattern, thus forming an image on the recording medium.

In devices of the type described above, there is need for a mechanism to hold and to advance the print medium during the course of creating images. This requirement is necessary to control media motion and hence image quality. The conventional means resort to vacuum hold-down whereby suction is created between the print medium and the print support by drawing air through small orifices on the support plate. This technique suffers from several disadvantages: the system is noisy with the use of a compressor; power consumption is high; and most critical of all, the airflow creates a disturbance to the drop trajectories leading to errors in drop placement that adversely affect print quality.

Electrostatic methods offer an improved tacking mechanism. The conventional approach is to use corona devices to spray charge onto dielectric surfaces to form the holding force. Two major disadvantages are: the residual charge needs to be neutralized to prevent static shock from contact with the transport surfaces, and the use of corona devices lead to ozone production which requires venting of the surrounding environment. A more viable alternative proposed in this invention is the use of fringe fields, which do not involve static charge and therefore charging devices. These fields are easily turned on and off and are sustained by application of low voltage to electrodes, which are embedded beneath the print medium. Therefore static shock is no longer a problem. A further advantage is that this method allows distributed tacking by controlling both electrode layout and switching voltages.

It is a purpose of this invention to generate electrostatic fields which provide a consistent and reliable tacking pressure, while accelerating the droplets to avoid deflection.

U.S. Pat. No. 6,079,814, which is assigned to the same assignee as the subject application and the disclosure of which is incorporated herein by reference, describes a printing system in which electrostatic fields are used to hold the paper (print medium) in place as it moves under the print head. In this instance, the electrostatic field is generated by a corona generating device such as a D-C scorotron. In the system of the '814 patent, as shown in FIG. 1, a detacking A-C scorotron is positioned to remove charge from the paper after it leaves the printing station. A dielectric surface is provided under the print medium and is charged by the D-C scorotron. This charge generates an attraction force which accelerates the ink droplets in a direction perpendicular to the surface of the print medium. In addition it creates an electrostatic pressure to hold the print medium to its transport mechanism. The transport mechanism can be a belt, drum, or flat platen. The use of corona generating devices have the disadvantage of forming residual charges on the printed portion of the print medium which may cause deflection in adjacent printing operations.

It is a purpose of this invention to generate the tacking force and the attraction force without using a corona generating device.

U.S. Pat. No. 5,975,683 entitled "Electric-Field Manipulation of Ejected Ink Drops in Printing" and assigned to the same assignee as the present invention, discloses electrodes behind the recording medium and/or on the print head face to induce charges on the ejected ink droplets and accelerate them toward the recording medium. By appropriately controlling the electrostatic deflection of the ink droplets created by each column of actuators in the print head, the droplets are selectively directed to impact the recording medium at positions both left and right of a center position, so that each actuator can create up to three vertical print columns of spots on the recording medium, thus enhancing the printing resolution of the device.

It is a purpose of this invention to generate the tacking and attraction fields through the use of electrodes under the print medium and to save energy by optimizing the attraction field.

SUMMARY OF THE INVENTION

An array of electrodes is arranged under the print medium in a ink jet printing system to generate an electrostatic field for providing both an attraction field and a tacking field. The attraction field accelerates the droplets from the print head perpendicular to the print medium. The tacking field provides an electrostatic pressure to hold the print medium to its supporting surface as it moves through the print station.

The electrodes are arranged in adjacent pairs in a suitable dielectric material and are supplied with a first D-C voltage which is equal and opposite in each electrode of a pair. Adjoining electrodes are spaced to provide a suitable dielectric gap. A first D-C voltage generates the tacking field. A second D-C voltage is applied to the array at a significantly stepped up voltage from the first voltage, while the print head is maintained at ground potential. The voltage difference between the print head and the array provides a field assist to enhance the attraction field of the device and improve drop placement accuracy. A dielectric coating separates the electrode array from the print medium. By adjusting the first voltage to selected groups of electrodes, the printing of a swath is facilitated while avoiding the complete release of the print medium between swaths.

BRIEF DESCRIPTION OF THE DRAWINGS

The present invention will now be described by way of example with reference to the accompanying drawings, wherein like reference numerals refer to like elements, and in which:

FIG. 7 is a graph of paper pressure versus air gap;

FIG. 8 is a graph of drop deflection versus distance from print head; and

DESCRIPTION OF THE PREFERRED EMBODIMENT

Figure 1:
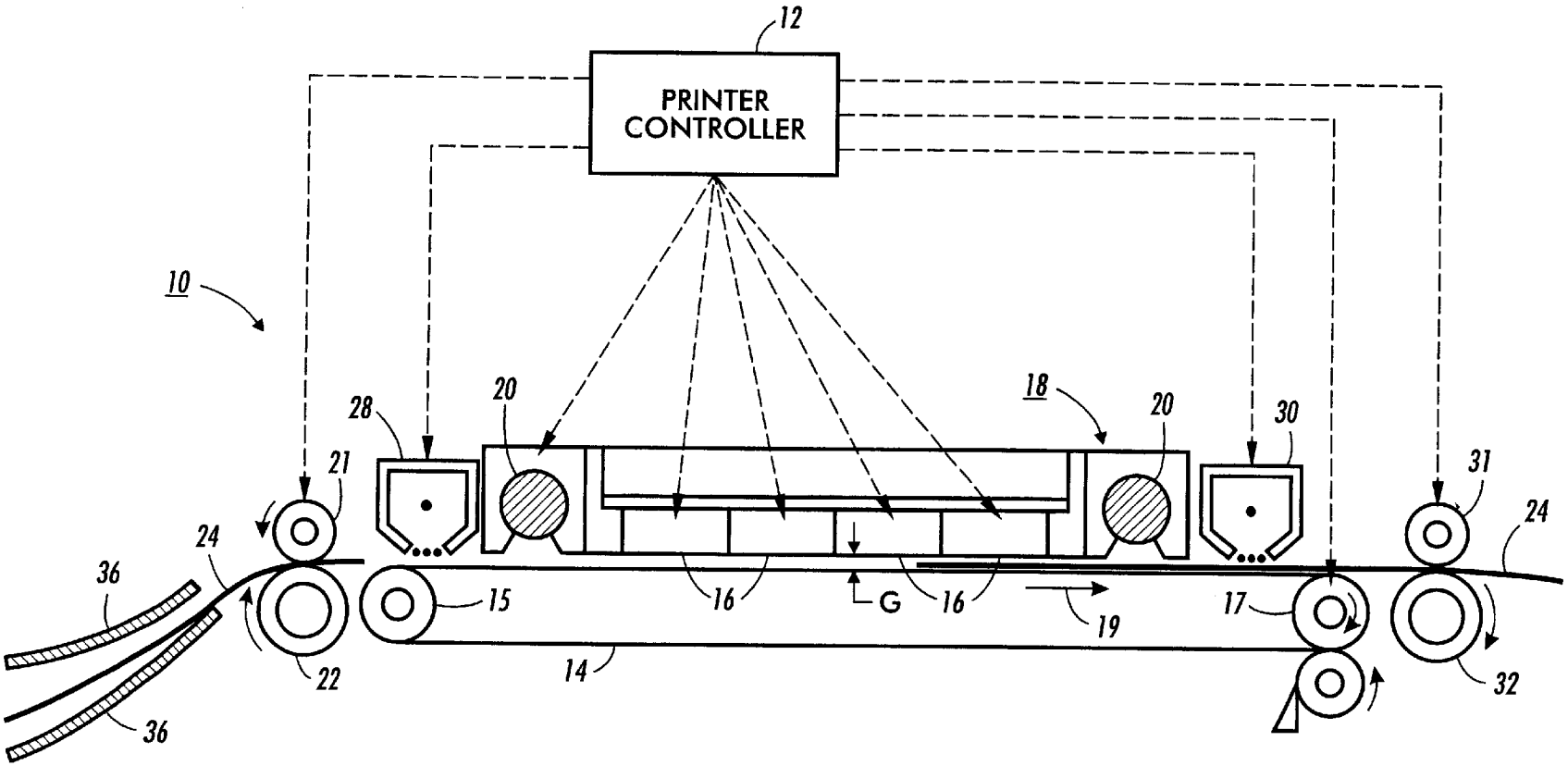
FIG. 1 PRIOR ART
FIG. 1 is a schematic, side view of an ink jet printer showing a and transport belt utilizing the field generating arrangement of the prior art.
Figure 4:
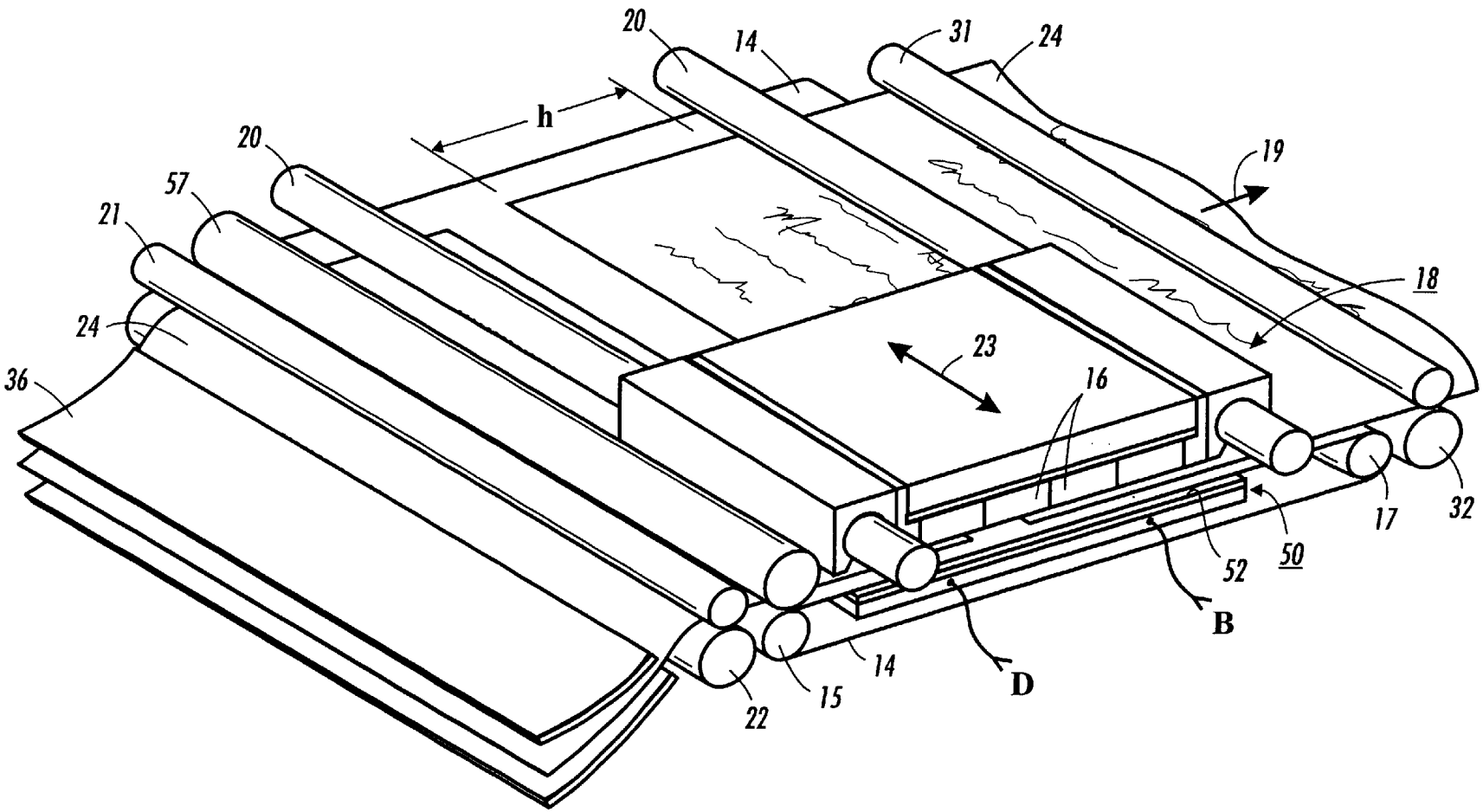
FIG. 4 is a perspective view of the printer of FIG. 1 modified according to this invention.

An ink jet printer 10 is depicted in FIG. 1 having a printer controller 12, a transport belt 14 entrained on idler roller 15 and drive roller 17 for movement in the direction of arrow 19. A plurality of ink jet print heads 16 are mounted on a carriage 18 which is translatable along guide rails 20 in a direction, as shown in FIG. 4 by arrow 23. A pair of input feed rollers 21 and 22 are provided for registering and feeding a recording medium 24, such as a sheet of paper, onto the transport belt 14.

In the system of the prior art, as shown in FIG. 1, the transport belt 14 is equipped with an outer dielectric surface and an inner conductive surface. The prior art printer has a first corona generating device 28, preferably a D-C scorotron, for applying an electrostatic tacking charge on the dielectric surface of the transport belt. The scorotron 28 is located at the end of the transport belt 14 adjacent the feed rollers 21, 22, and a second corona generating device 30, preferably an A-C scorotron, for detacking the recording medium, which is located at the other end of the transport belt 14. A pair of output feed rollers 31, 32 drive the recording medium from the transport belt 14.

The printer controller 12 directly communicates with and controls the input feed rollers 21, 22, which accepts the recording medium from the input tray (not shown) and a pair of guides 36. The recording medium is directed to input feed rollers by movement of the transport belt 14 which is driven by a stepper motor (not shown).

Figure 5:
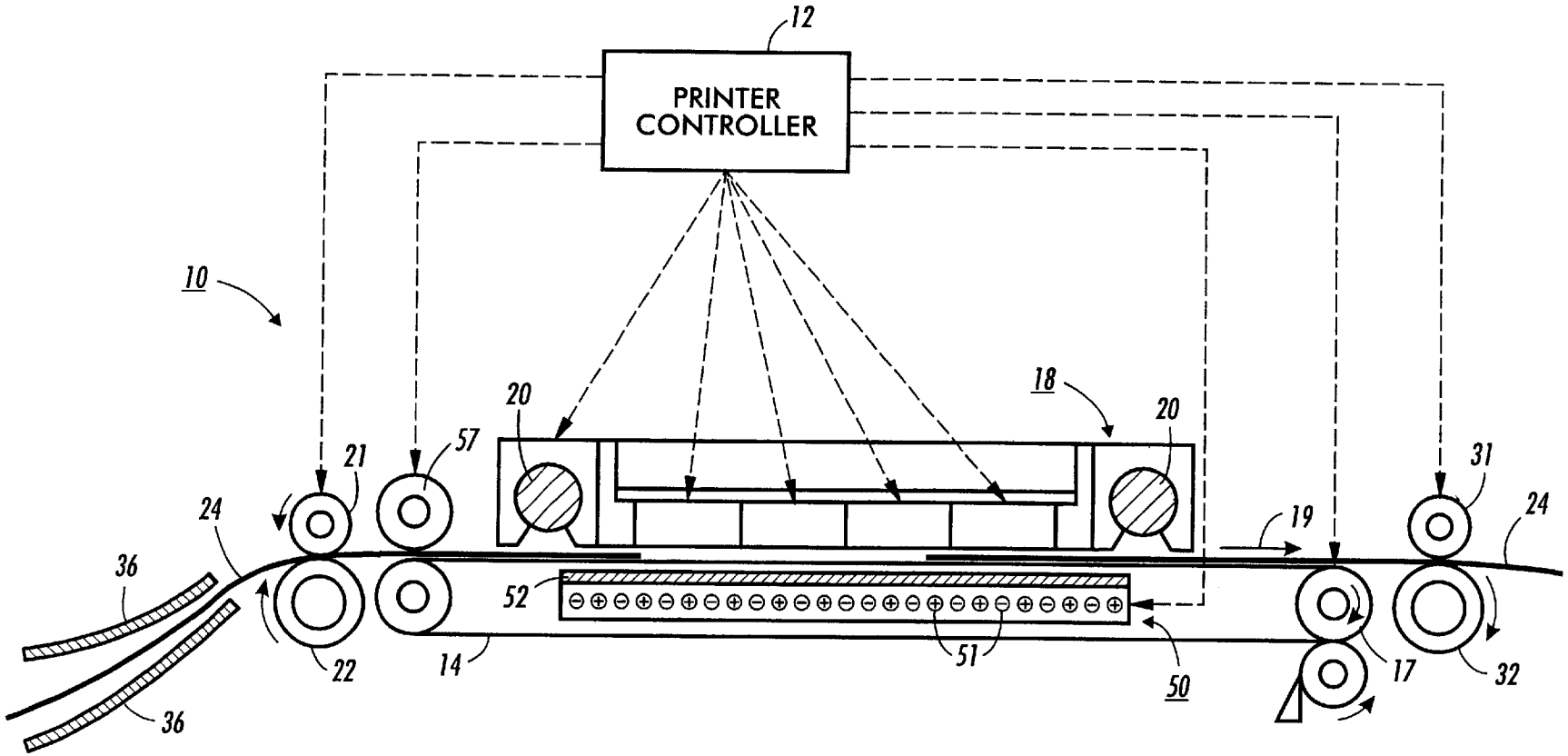
FIG. 5 is a schematic side view of an ink jet printer having the electrode array of this invention.

A similar printer configuration is shown in FIGS. 4 and 5 to illustrate a preferred embodiment of this invention. Common elements are as described above with like reference numerals used. To incorporate the fringe field method, a grounded compliant conductive roll 57 is used to iron the print medium 24 onto the inter-digitated electrode array 50 to remove air gaps. The ink jet print heads 16 are translatable, partial width print heads, one print head for each of four colors, and the transport belt 14 is held stationary by the printer controller while the print heads 16 print a swath of an image of height h. The paper is then advanced a distance equal to h until the entire image is printed. This particular print head design is for illustration and the invention is not limited in this regard.

The printer controller 12 controls the ink droplet ejectors 42 (see FIG. 3) in each of the print heads 16. For illustration the invention is depicted in association with an acoustic ink jet print head having acoustic ink droplet ejectors, although other types of print heads are possible, including thermal ink jet and piezoelectric ink jet droplet ejectors. The printer controller 12 directly communicates with and controls the acoustic ink droplet ejectors 42 formed in the print heads 16.

Figure 3:
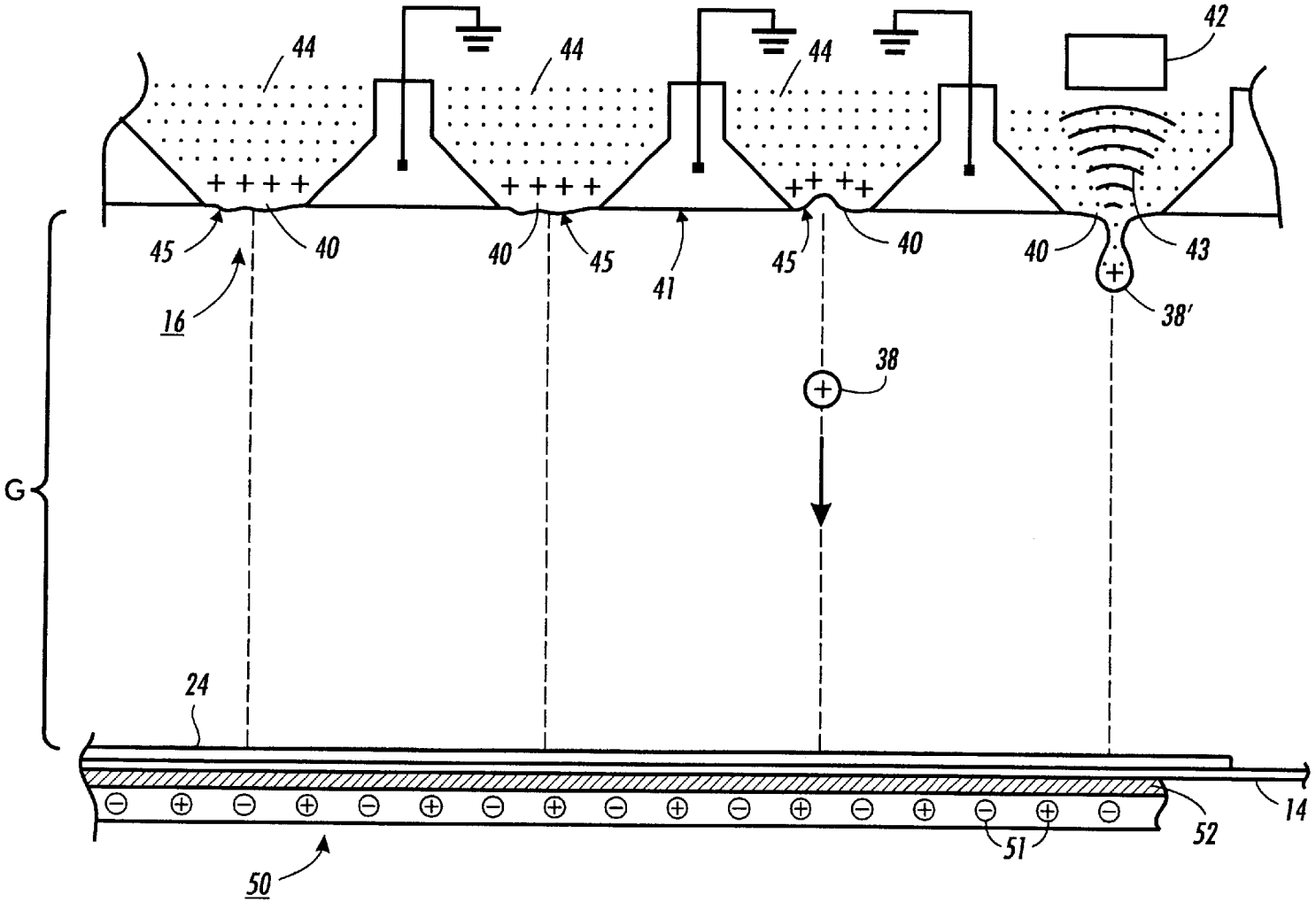
FIG. 3 is a schematic representation of the invention showing ink droplets being accelerated toward a recording medium.

Referring to FIG. 3, a schematic representation of the invention is shown in an enlarged cross-sectional view of a portion of the print head 16. The printer 10 is shown to include, the transport belt 14 with the recording medium 24 thereon. A gap G exists between the face 41 of the print head 16 and the transport belt 14. The print head 16 is grounded. The print head 16 ejects ink droplets 38 through the print head apertures 40 directed toward the recording medium 24 using acoustic ink droplet ejectors 42. Each acoustic ink droplet ejector includes a piezoelectric transducer of RF source which creates a sound wave 43 in the ink 44 stored in the print head 14. A lens (not shown), such as a Fresnel lens, focuses the sound wave at the ink surface 45 in the apertures 40. The acoustic pressure at the ink surface 45 causes the formation of an ink droplet 38 which has a charge induced therein by the electrostatic field generated by the array 50 as described below.

The fully formed and ejected droplet 38 is directed and propelled towards the recording medium 24 at a velocity of about 4 meters/second initially, but the induced charge accelerates the droplet toward the paper. The fringe fields, generated as discussed below, on the dielectric surface of the transport belt concurrently tack the recording medium to the transport belt and provides the electrostatic field to induce charges on the ink droplets which increases the droplet velocity and thereby enhances droplet deposition accuracy and improves print quality of the printed images.

Figure 2A:
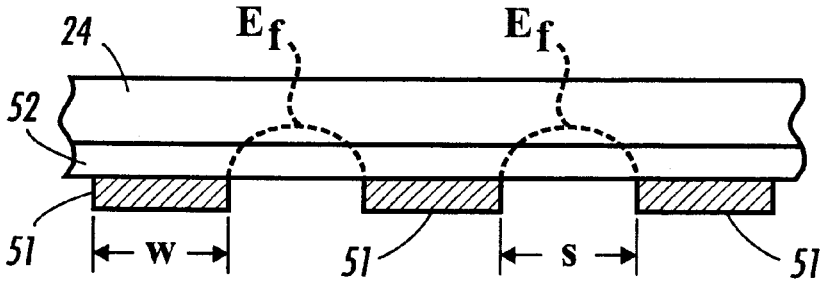
FIGS. 2*a* and 2*b* are simplified schematic diagrams showing the field generation of this invention.
Figure 6:
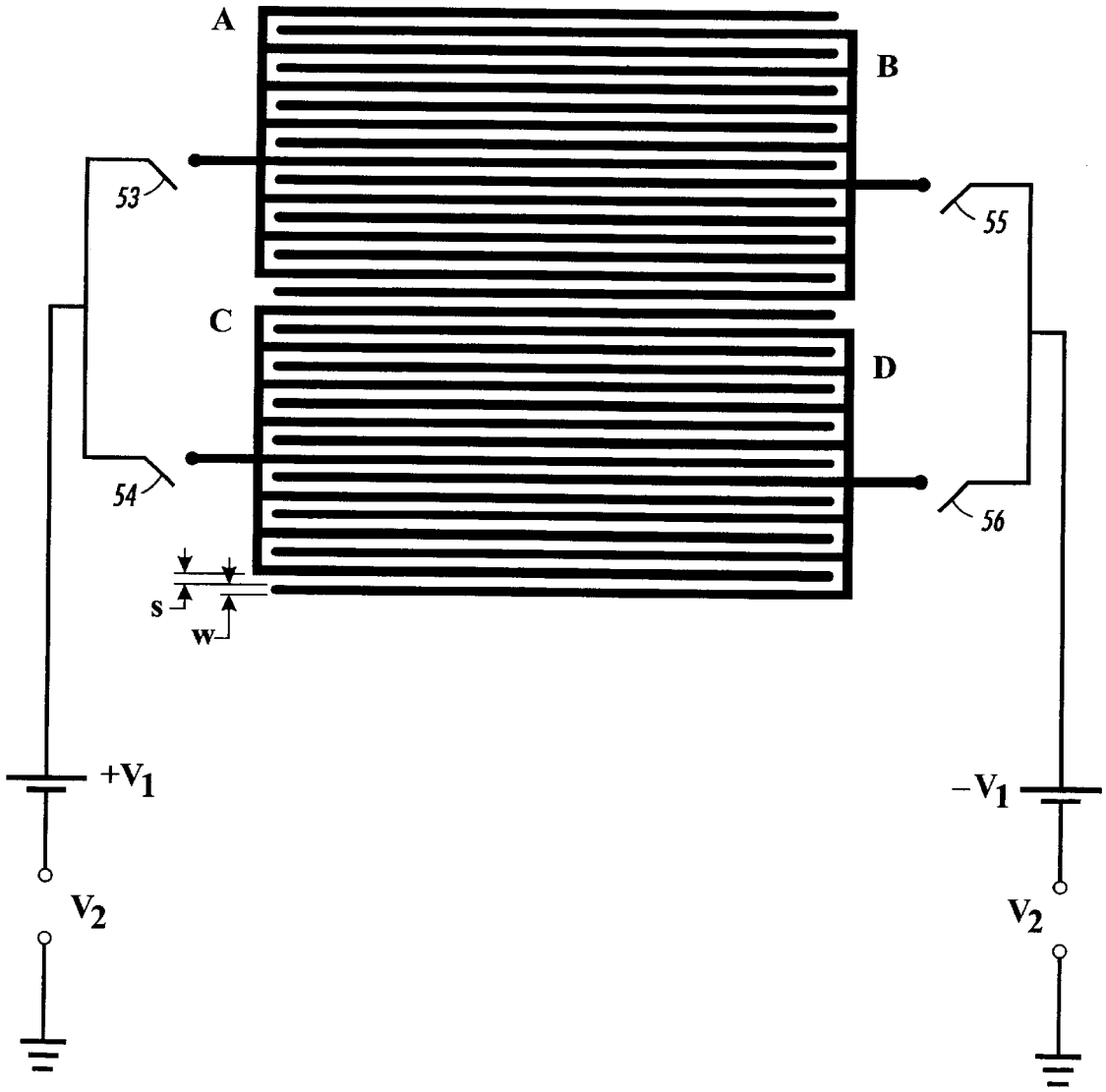
FIG. 6 is a circuit diagram of the electrode array of this invention.

In the printer system 10, as shown in FIGS. 3–5, in accordance with this invention, an array 50 of electrodes 51 is positioned below the paper 24 and separated from the paper 24 by a dielectric layer or coating 52. The array 50 is constructed as shown in FIG. 6 and consists of contiguous pairs of electrodes 51 arranged in four groups, A through D. As illustrated, group A and group B are arranged in an opposing manner such that an electrode 51 of group A alternates with an electrode of group B. The electrodes 51 of group C and group D are similarly arranged in an opposing manner. Each electrode 51 has a width w and is spaced a distance s from its adjacent electrode, as shown in FIG. 2*a*. The gap s contains insulation to separate each electrode from its adjacent electrode. The configuration can be constructed as a printed circuit board for connection as follows.

In order to generate an electrostatic tacking pressure to hold the paper 24 to the transport belt 14, opposing groups of electrodes are connected to voltages which are equal and opposite, namely, $+V_1$ and $-V_1$. Therefore, as shown in FIG. 6, groups A and C are connected to $+V_1$ and groups B and D are connected to $-V_1$. These connections are made through a series of group switches 53 through 56 to allow selective control of the tacking field. The array 50 is connected to a bias voltage $V_2$ which is set at a positive 1 kV above ground while the print head 16 is maintained at ground. The voltage $V_2$ generates an induced negative charge within the ink droplets 38 to accelerate the drop towards the paper 24.

Figure 2B:
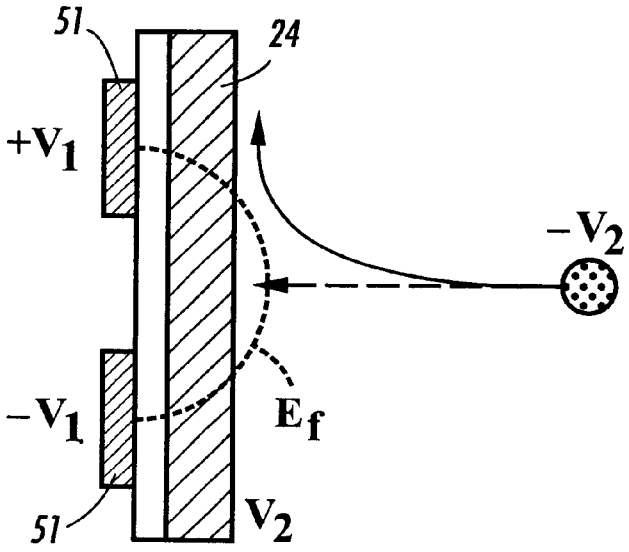
Figure 9:
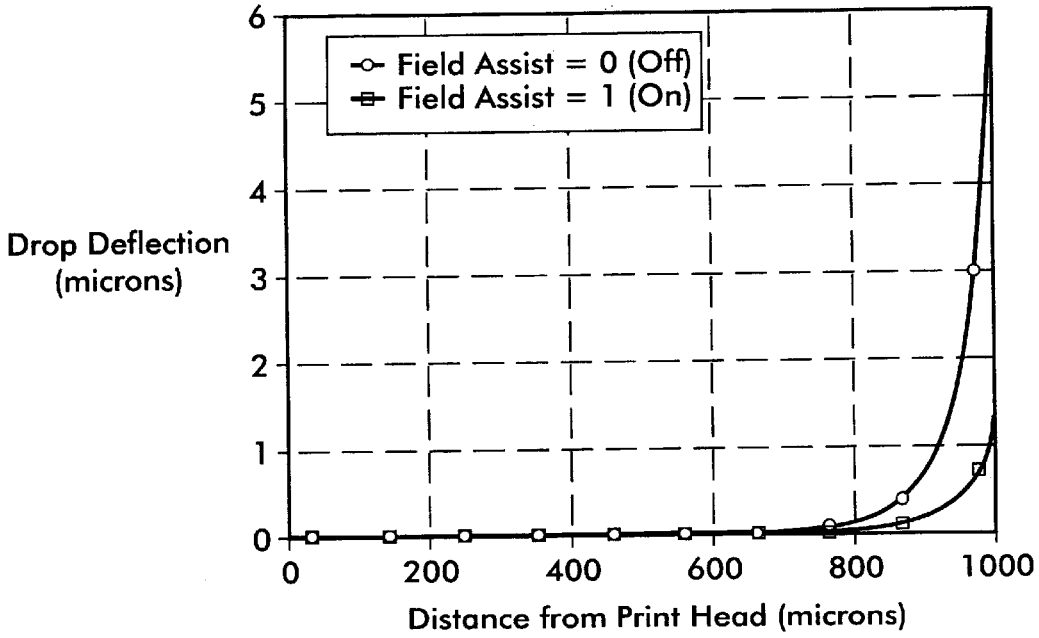
FIG. 9 is a graph of drop deflection versus distance from print head showing the effect of field assist.

A partial array of electrodes 51 is shown in FIGS. 2*a* and 2*b*. The voltage $+V_1$ and $-V_1$, generate fringe fields $E_f$. These fields $E_f$ can be adjusted by varying the pitch of the array which is defined as w+s and the duty cycle which is defined as w/[w+s]. A pitch of 4.3 mils with a duty cycle of 75% has been shown to be effective. These data are shown in the graphs of FIGS. 8 and 9. Accordingly electrostatic means are provided to both hold down the print medium and to accelerate the drop thus producing much improved drop directionality.

The tacking is accomplished by using fringe fields generated by the electrode array 50. The pitch of these electrodes determines both the magnitude and decay rates of these holding forces. These fields have been optimized through computer models and shown to have two useable modes (as shown in FIG. 7). A high pitch mode leads to high holding forces which decay rapidly as a function of increasing air gap and may be suitable for use when the print medium is stationary during the printing process. A lower pitch mode has lower holding force but decays less rapidly, and may be suitable during the paper advance stage when printing is off. The drop acceleration is dependent on inductive charging of the drop. A net charge of the opposite polarity to the print support voltage is induced on the drop provided the ink has a moderate level of electrical conductivity. The drop is then accelerated by Coulomb force towards the print medium.

The fringe field technique may impact the drop trajectory as the drop approaches the print medium 24. The spatially alternating voltage on adjacent electrode pairs may deflect the drop towards the electrode of the opposite polarity, as shown in FIG. 2*b,* thus leading to image blooming. The amount of blooming may be quantified by computer models and has been shown to decrease rapidly with increasing pitch of the electrode array 50 (as shown in the FIG. 9). This blooming is reduced, as shown in the FIG. 10, by using the acceleration field generated by the voltage $V_2$.

In order to facilitate advancement of the paper 24, while avoiding the occurrence of an air gap between the paper and its supporting surface. The printer controller is connected to the array 50 to adjust the tacking field by selectively opening the group switches 54 and 55 53 56. This effectively increases the pitch three fold, thus leading to lower tacking pressures without total release of the print medium. In this manner the tacking pressure can be stepped down when the paper is to be advanced. During advancement a reduced amount of tacking pressure is maintained so that an irretrievable air gap is avoided.

Positive ions in the aqueous based ink congregate at the ink surface 45 in response to the high electrostatic negative potential of approximately 800 to 1200 volts placed on the dielectric surface 52 by the array 50. The fringe field on the dielectric surface of the transport belt sustains an electric field across the printing gap G, as shown in FIG. 3. The induced charge effect on the ink exposed in the apertures is enhanced by the protrusion 38' of the ink during the formation of a droplet 38. Therefore, when each ink droplet 38 separates from the ink surface 45, the ink droplet 38 is positively charged and is strongly attracted toward paper 24. As the ink droplet 38 travels the distance of gap G, the droplet is accelerated to approximately 3 or 4 times its initial ejection velocity. The increase in droplet velocity reduces errors in droplet placement on the recording medium by minimizing droplet deflections caused by transverse effects or forces, such as airflow, fringing fields, and skewed ejection angles.

While the invention has been described with reference to specific embodiments, the description of the specific embodiments is illustrative only and is not to be construed as limiting the scope of the invention. Various other modifications and changes may occur to those skilled in the art without departing from the spirit and scope of the invention.

What is claimed is:

1. A method of improving ink droplet placement on a recording medium by an ink jet printer, said printer having a print head from which ink droplets are ejected and a transport mechanism for advancing a print medium under said print head, said printer being controlled by a processor, said method comprising the steps of:

mounting an array of electrodes within said transport mechanism, said array having a plurality of pairs of first and second electrodes, each electrode in said pair being independently connected to a voltage source;

connecting each of said first electrodes to a predetermined first voltage;

connecting each of said second electrodes to predetermined second voltage which is equal and opposite to said first voltage, a voltage difference generating an electrostatic tacking field between said first and second electrodes;

connecting the array of electrodes to a predetermined bias voltage to create a voltage difference between said array and said print head; and wherein said electrodes are positioned with respect to each other and within the transport mechanism to generate an attraction field for accelerating said ink droplets towards said print medium and said tacking field to generate an electrostatic pressure on said print medium against said transport mechanism.

2. A method of improving ink droplet placement on a recording medium by an ink jet printer, said printer having a print head from which ink droplets are ejected and a transport mechanism for advancing a print medium under said print head, said printer being controlled by a processor, said method, as described in claim 1, further comprising the step of separating said electrode array from said transport mechanism by a dielectric layer to enhance the generation and performance of said attraction and tacking fields.

3. A method of improving ink droplet placement on a recording medium by an ink jet printer, said printer having a print head from which ink droplets are ejected and a transport mechanism for advancing a print medium under said print head, said printer being controlled by a processor, said method, as described in claim 1, further comprising the step of constructing the electrode array as a printed circuit in a dielectric board.

4. A method of improving ink droplet placement on a recording medium by an ink jet printer, said printer having a print head from which ink droplets are ejected and a transport mechanism for advancing a print medium under said print head, said printer being controlled by a processor, said method, as described in claim 1, further comprising the step of constructing said electrode array wherein said pairs of electrodes are arranged in groups and each of said groups is independently controlled by said printer processor to adjust the tacking field.

5. A method of improving ink droplet placement on a recording medium by an ink jet printer, said printer having a print head from which ink droplets are ejected and a transport mechanism for advancing a print medium under said print head, said printer being controlled by a processor, said method, as described in claim 4, further comprising the steps of:

printing an image on said print medium in a swath across said print medium;

advancing said print medium under said print head to position the print medium to receive an adjacent swath of said image; and adjusting the tacking field to reduce the electrostatic pressure on said print medium as said print medium is advanced.

6. An ink jet printer comprising:

a print head from which ink droplets are ejected;

a transport mechanism for advancing a print medium under said print head;

a processor for controlling the function of said printer;

an array of electrodes mounted within said transport mechanism, said array having a plurality of pairs of first and second electrodes, each electrode in said pair being independently connected to a voltage source;

a first voltage source connected to each of said first electrodes to supply a predetermined first voltage thereto;

a second voltage source connected to each of said second electrodes to supply a predetermined second voltage which is equal and opposite to said first voltage, a voltage difference generating an electrostatic tacking field between said first and second electrodes;

a bias voltage source connected to the array of electrodes to supply a predetermined bias voltage thereto create a voltage difference between said array and said print head; and wherein said electrodes are positioned with respect to each other and within the transport mechanism to generate an attraction field for accelerating said ink droplets towards said print medium and said tacking field to generate an electrostatic pressure on said print medium against said transport mechanism.

7. An ink jet printer, as described in claim 6, further comprising a dielectric layer separating said electrode array from said transport mechanism to enhance the generation and performance of said attraction and tacking fields.

8. An ink jet printer, as described in claim 6, wherein the electrode array is constructed as a printed circuit in a dielectric board.

9. An ink jet printer, as described in claim 6, wherein said pairs of electrodes are arranged in groups and each of said groups is independently controlled by said printer processor to adjust the tacking field.

10. An ink jet printer, as described in claim 9, wherein said printer processor controls the print head to print an image on said print medium in a swath across said print medium;

said transport mechanism is controlled by said processor to advance said print medium under said print head to position the print medium to receive an adjacent swath of said image; and said printer processor adjusts the tacking field to reduce the electrostatic pressure on said print medium as said print medium is advanced by selectively connecting one or more of said groups of electrodes.

11. In an ink jet printer having a print head from which ink droplets are ejected and a transport mechanism for advancing a print medium under said print head, said printer being controlled by a processor, a system for generating electrostatic fields comprising:

an array of electrodes mounted within said transport mechanism, said array having a plurality of pairs of first and second electrodes, each electrode in said pair being independently connected to a voltage source;

a first voltage source connected to each of said first electrodes to supply a predetermined first voltage thereto;

a second voltage source connected to each of said second electrodes to supply a predetermined second voltage which is equal and opposite to said first voltage, a voltage difference generating an electrostatic tacking field between said first and second electrodes;

a bias voltage source connected to the array of electrodes to supply a predetermined bias voltage thereto to create a voltage difference between said array and said print head; and wherein said electrodes are positioned with respect to each other and within the transport mechanism to generate an attraction field for accelerating said ink droplets towards said print medium and said tacking field to generate an electrostatic pressure on said print medium against said transport mechanism.

12. In an ink jet printer having a print head from which ink droplets are ejected and a transport mechanism for advancing a print medium under said print head, said printer being controlled by a processor, a system for generating electrostatic fields, as described in claim 11, further comprising a dielectric layer separating said electrode array from said transport mechanism to enhance the generation and performance of said attraction and tacking fields.

13. In an ink jet printer having a print head from which ink droplets are ejected and a transport mechanism for advancing a print medium under said print head, said printer being controlled by a processor, a system for generating electrostatic fields, as described in claim 11, wherein the electrode array is constructed as a printed circuit in a dielectric board.

14. In an ink jet printer having a print head from which ink droplets are ejected and a transport mechanism for advancing a print medium under said print head, said printer being controlled by a processor, a system for generating electrostatic fields, as described in claim 11, wherein said pairs of electrodes are arranged in groups and each of said groups is independently controlled by said printer processor to adjust the tacking field.

15. In an ink jet printer having a print head from which ink droplets are ejected and a transport mechanism for advancing a print medium under said print head, said printer being controlled by a processor, a system for generating electrostatic fields, as described in claim 14, wherein said printer processor controls the print head to print an image on said print medium in a swath across said print medium;

said transport mechanism is controlled by said processor to advance said print medium under said print head to position the print medium to receive an adjacent swath of said image; and said printer processor adjusts the tacking field to reduce the electrostatic pressure on said print medium as said print medium is advanced by selectively connecting one or more of said groups of electrodes.

* * * * *